US006177857B1

(12) United States Patent
Inoue

(10) Patent No.: US 6,177,857 B1
(45) **Date of Patent: *Jan. 23, 2001**

(54) THERMISTOR DEVICE

(75) Inventor: Hidehiro Inoue, Ohmihachiman (JP)

(73) Assignee: Murata Manufacturing Co., Ltd., Nagaokakyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/590,484

(22) Filed: Jan. 24, 1996

(30) Foreign Application Priority Data

Jan. 26, 1995 (JP) ..... 7-010417

(51) Int. Cl.[7] ..... H01C 7/13

(52) U.S. Cl. ..... 338/22 R; 338/22 SD; 338/324; 338/328

(58) Field of Search ..... 338/22 SD, 22 R, 338/254, 324, 327, 328, 195

(56) References Cited

U.S. PATENT DOCUMENTS

| | | | | |
|---|---|---|---|---|
| 3,037,180 | * | 5/1962 | Linz, Jr. | 338/327 |
| 3,412,359 | * | 11/1968 | Schwyn et al. | 338/30 |
| 3,793,604 | * | 2/1974 | Duggan et al. | 338/22 R |
| 4,031,499 | * | 6/1977 | Brueckner | 338/23 |
| 4,053,864 | * | 10/1977 | Rodriguez et al. | 338/22 SD |
| 4,251,792 | * | 2/1981 | Ball, Jr. | 338/22 R |
| 4,431,983 | * | 2/1984 | Rodriguez | 338/220 |
| 4,635,026 | * | 1/1987 | Takeuchi | 338/22 SD |
| 4,801,784 | * | 1/1989 | Jensen et al. | 219/548 |
| 4,924,204 | * | 5/1990 | Uchida | 338/22 R |
| 5,210,516 | * | 5/1993 | Shikama et al. | 338/22 R |
| 5,289,155 | | 2/1994 | Okumura et al. | 338/22 SD |
| 5,337,038 | * | 8/1994 | Taniguchi et al. | 338/22 R |
| 5,557,251 | * | 9/1996 | Takaoka | 338/22 R |

FOREIGN PATENT DOCUMENTS

| | | | | |
|---|---|---|---|---|
| 1-318 202 | | 12/1989 | (JP) . | |
| 403174701 | * | 7/1991 | (JP) | 338/22 SD |
| WO95/24046 | | 9/1995 | (WO) . | |
| 95/24046 | * | 9/1995 | (WO) . | |

* cited by examiner

*Primary Examiner*—Karl D. Easthom
(74) *Attorney, Agent, or Firm*—Burns, Doane, Swecker & Mathis, LLP

(57) ABSTRACT

A thermistor device manufactured at low cost in which atoms of Ag do not migrate substantially into the thermistor body. The device comprises a disk-like thermistor body and annular first electrodes formed in peripheral portions of the front and back surfaces, respectively, of the thermistor body. The first electrodes are made from a conductive material not containing silver. Second electrodes are formed in central portions of the front and back surfaces, respectively, of the thermistor body. The second electrodes are in ohmic contact with the thermistor body, and are made from a conductive material made mostly of silver.

13 Claims, 3 Drawing Sheets

THERMISTOR DEVICE

BACKGROUND OF THE INVENTION

1. Field of the Invention

The present invention relates to thermistor devices and, more particularly, to a positive-characteristic thermistor device used in a demagnetizing circuit incorporated in a TV receiver and also to a negative-characteristic thermistor device used in a temperature-compensating circuit or the like.

2. Description of the Prior Art

A known thermistor device having a positive or negative temperature coefficient is shown in FIGS. 7 and 8. The body of the thermistor is indicated by numeral 30. Electrodes 31 and 32 made from a conductive material consisting mainly of silver (Ag) are formed on the front and back surfaces, respectively, of the thermistor body 30. The electrodes 31 and 32 are in ohmic contact with the thermistor body 30.

In the thermistor device of this construction, if a potential difference is developed between the electrodes 31 and 32, some Ag atoms forming the material of the electrodes 31 and 32 migrate across the surface of the thermistor body 30, thus deteriorating the insulating performance. In the worst case, the electrodes 31 and 32 are shorted together. Referring to FIG. 8, A and D refer to the outer ends of the electrodes 31 and 32, respectively, and B and C refer to the left and right edges, respectively, of the outer end surface of the thermistor body 30. Because of the resistive component of the thermistor body 30, potential differences are produced between A and B, between B and C, and between C and D on the surface of the thermistor body 30. These potential differences cause migration of the Ag atoms forming the electrodes 31 and 32.

Another thermistor device equipped with means for reducing or slowing this problem has been proposed, and is shown in FIGS. 9 and 10. This thermistor device is similar to the known thermistor device already described in conjunction with FIGS. 7 and 8 except that the surface of the thermistor body 30, excluding the portions covered by the electrodes 31 and 32, is coated with an insulating film 33 made of a resin, glass, or the like. As shown in FIGS. 9 and 10, the Ag migration entails the movement of metal caused by a potential difference between A and B, between B and C, and between C and D. In addition, if there is a potential difference, the migration velocity is accelerated when the thermistor device is operated in a moist atmosphere, and the electrolytic ion such as chloric ions, sulfurate ions, or the like are absorbed onto the thermistor surface on operating. Coating the thermistor body with resin or glass will prevent water and the electrolytic ions from being absorbed onto the thermistor surface, thus maintaining the migration at a low velocity.

However, it is costly to fabricate this thermistor device shown in FIGS. 9 and 10, because it is cumbersome to coat the outer surface of the thermistor body 30 with the insulating film 33 made of a resin or glass.

SUMMARY OF THE INVENTION

Accordingly, it is an object of the present invention to provide a thermistor device which is economical to fabricate and is free or substantially free from migration of Ag atoms.

This object is achieved in accordance with the invention by a thermistor device comprising a thermistor body, first electrodes formed in peripheral portions of the front and back surfaces, respectively, of the thermistor body, and second electrodes formed at least in central portions of the front and back surfaces, respectively, of the thermistor body. The first electrodes are made from a conductive material not containing silver (Ag). The second electrodes are made from a conductive material principally including silver (Ag).

In this construction, the outer surface of the thermistor body is not required to be coated with an insulating film. Even if a potential difference is produced between the second electrodes formed on the front and back surfaces, respectively, of the thermistor body, the first electrodes made from the conductive material not containing Ag prevents migration of Ag atoms from the second electrodes for reasons explained below.

BRIEF DESCRIPTION OF THE DRAWINGS

The invention will now be described by way of exemplary embodiments illustrated in the accompanying drawings in which.

DETAILED DESCRIPTION OF THE INVENTION

Figure 1:
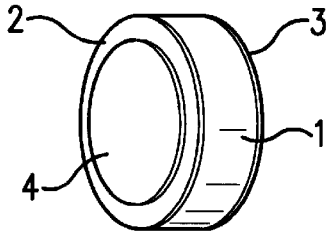
FIG. 1 is a perspective view of a thermistor device according to the present invention.
Figure 2:
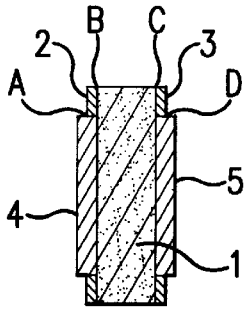
FIG. 2 is a cross-sectional view of the thermistor device shown in FIG. 1.
Figure 2:
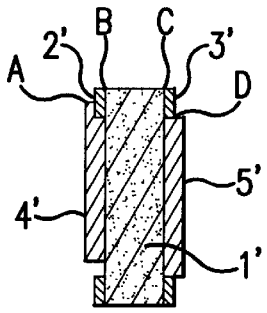

Referring to FIGS. 1 and 2, there is shown a thermistor device according to the present invention. This thermistor device comprises a disk-like thermistor body 1. First annular electrodes 2 and 3 are formed at peripheral portions of the front and back surfaces, respectively, of the thermistor body 1. The first electrodes 2 and 3 are made from a conductive material not containing silver (Ag), such as a metallic paste including mainly nickel (Ni). The first electrodes 2 and 3 may be made up of other materials containing aluminum, indium, gallium, chromium, zinc, or copper, and alloys thereof. The first electrodes do not contain silver and consist essentially of a material which does not generates inter-electrode migration. This metallic paste is applied to the front and back surfaces of the thermistor body 1 by screen printing or other methods.

Where the thermistor device has a positive temperature coefficient, a ceramic material such as $BaTiO_3$ is used as the material of the thermistor body 1. Where the thermistor device has a negative temperature coefficient, a ceramic material such as $Mn_2O_3$ or $Co_2O_3$ is employed as the material of the thermistor body 1.

Second electrodes 4 and 5 are formed in central portions of the front and back surfaces, respectively, of the thermistor body 1. The second electrodes 4 and 5 are in ohmic contact with the thermistor body 1. The outer ends of the second electrodes 4 and 5 are in contact with the inner ends of the first electrodes 2 and 3, respectively.

It is not always necessary that the first electrodes 2 and 3 be in ohmic contact with the thermistor body 1. However, where a material making ohmic contact with the thermistor body 1 is used as the material of the first electrodes 2 and 3, variations in the resistance values of different thermistor devices are reduced with desirable results. The reason variations in the resistance values of manufactured thermistors are reduced if the first electrodes 2 and 3 are made of material making ohmic contact with the thermistor body 1 is as follows:

As shown in FIG. 2', the second electrodes 4' and 5' have shifted relative to the first annular electrodes 2' and 3'. In this case, if the first electrodes 2' and 3' are not in ohmic contact with the thermistor body, the resistance value is increased because the average current path becomes longer compared to the case where the second electrodes 4 and 5 are formed centered in the first annular electrodes 1 and 2 as shown in FIG. 2. Such shifts in the registration of the two sets of electrodes can happen anytime as a result of the manufacturing process.

Where the thermistor device has a positive temperature coefficient, a conductive material consisting principally of Ag, such as Ag, Ag—Zn, Ag—In, Ag—Ga, Ag—Zn, or Ag—Sb, is used as the material of the second electrodes 4 and 5. Paste of this material is applied to the front and back surfaces of the thermistor body 1 by screen printing or another suitable method. Where the thermistor device has a negative temperature coefficient, a conductive material consisting mainly of Ag, such as Ag or Ag—Pd, is used of the second electrodes 4 and 5. Paste of this material is applied to the front and back surfaces of the thermistor body 1 by screen printing or another suitable method. The first electrodes do not contain silver and consist essentially of a material which does not generates inter-electrode migration.

The thermistor body 1 constructed as described above is baked at a temperature of about 900° C. for 30 minutes in a nitrogen atmosphere. The outer surface of the resulting thermistor body 1 is not required to be coated with an insulating film and this cumbersome operation can be dispensed with. Hence, this thermistor device can be manufactured at a lower cost than the prior art.

Since the first electrodes 2 and 3 are made from a conductive material not containing silver (Ag), if a potential difference is produced between the second electrodes 4 and 5, the atoms of the silver forming the second electrodes 4 and 5 do not migrate, for the following reasons. Referring to FIG. 2, A and D represent the outer ends of the second electrodes 4 and 5, respectively, and B and C represent the left and right edges, respectively, of the outer end surfaces of the thermistor body 1. A potential difference due to the resistive component of the thermistor body 1 is produced only between the edges B and C on the surface of the thermistor body 1. No potential difference is created between A and B or between C and D because of the uniform potential caused by the first electrodes 2 and 3. Therefore, the Ag atoms in the second electrodes 4 and 5 are prevented from migrating by the first electrodes 2 and 3 which surround the second electrodes 4 and 5. As a consequence, the reliability of the insulating performance of the thermistor device is enhanced. As illustrated, the second electrodes are consistently thicker and of a greater surface area than said first electrodes to provide a consistently planar surface over all of an outermost surface of the second electrodes on the front and back surfaces of the thermistor body and do not form an uneven profile at inner edges of said first electrodes and outer edges of said second electrodes.

Figure 3:
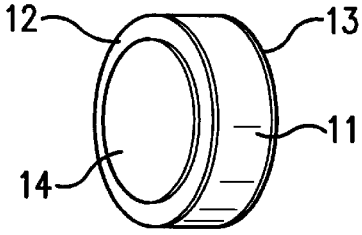
FIG. 3 is a perspective view of another thermistor device according to the invention.
Figure 4:
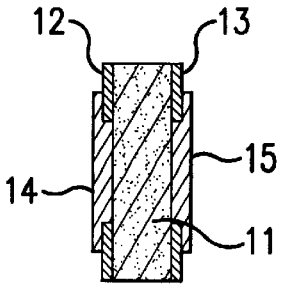
FIG. 4 is a cross-sectional view of the thermistor device shown in FIG. 3.
Figure 4:
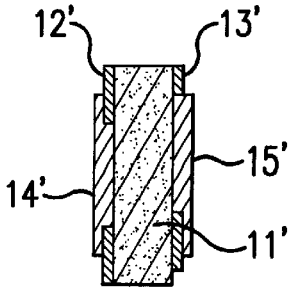

Referring next to FIGS. 3 and 4, there is shown a further thermistor device according to the invention. This thermistor device has a disk-like thermistor body 11. Annular first electrodes 12 and 13 are formed in peripheral portions of the front and back surfaces, respectively, of the disk-like thermistor body 11. Second electrodes 14 and 15 are formed in central portions of the front and back surfaces, respectively, of the thermistor body 11. The second electrodes 14 and 15 are in ohmic contact with the thermistor body 11. Outer portions of the second electrodes 14 and 15 overlap inner portions of the first electrodes 12 and 13, respectively. The thermistor device constructed in this way yields the same advantages as the thermistor device described already in connection with FIGS. 1 and 2. For example, variations in the resistance values of manufactured thermistors are reduced when the first electrodes 12 and 13 make ohmic contact with the thermistor body 11 for the following reasons.

As shown in FIG. 4', the first electrode 13' has been shifted relative to the center portion of the thermistor's circular surface. In this case, if the first electrodes 12' and 13' are not in ohmic contact with the thermistor body, a variation in the resistance value is caused because the areas of the ohmic contact which function as electrodes differ from thermistor body to thermistor body.

Figure 5:
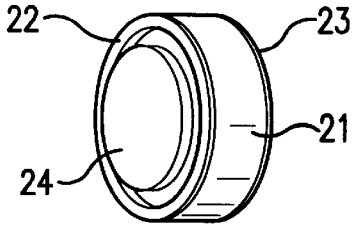
FIG. 5 is a perspective view of a further thermistor device according to the invention.
Figure 6:
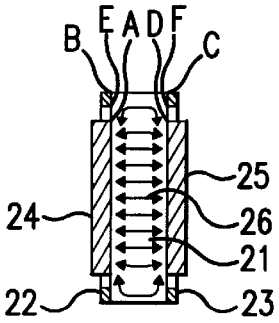
FIG. 6 is a cross-sectional view of the thermistor device shown in FIG. 5.
Figure 7:
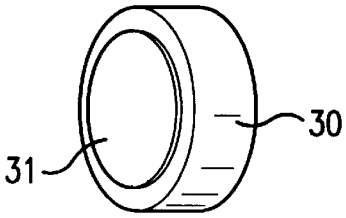
FIG.7 PRIOR ART
FIG. 7 is a perspective view of a conventional thermistor device.
Figure 8:
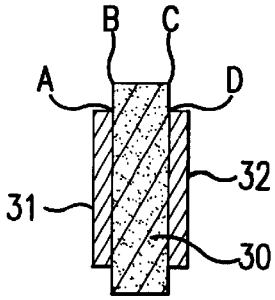
FIG.8 PRIOR ART
FIG. 8 is a cross-sectional view of the conventional thermistor device shown in FIG. 7.
Figure 9:
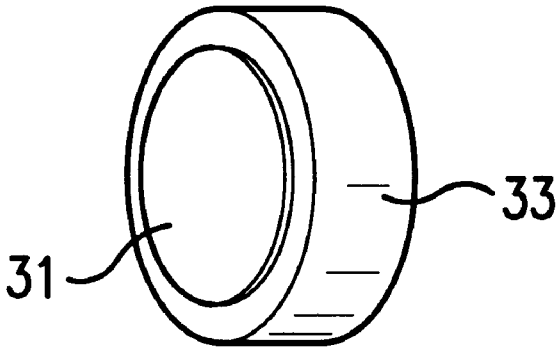
FIG.9 PRIOR ART
FIG. 9 is a perspective view of a known thermistor device.
Figure 10:
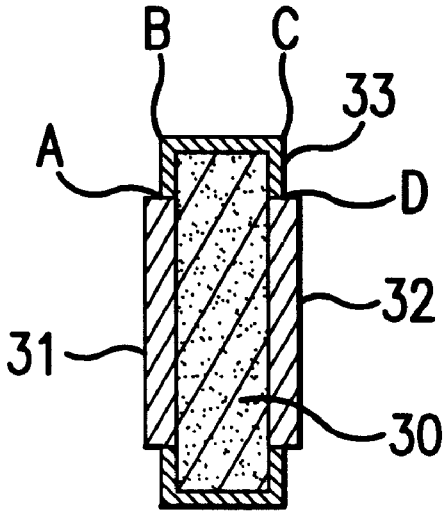
FIG.10 PRIOR ART
FIG. 10 is a cross-sectional view of the known thermistor device shown in FIG. 9.

Referring next to FIGS. 5 and 6, there is shown a yet other thermistor device according to the invention. This thermistor device comprises a disk-like thermistor body 21. Annular first electrodes 22 and 23 are formed in peripheral portions of the front and back surfaces, respectively, of the thermistor body 21. Second electrodes 24 and 25 are formed in central portions of the front and back surfaces, respectively, of the thermistor body 21. The second electrodes 24 and 25 are in ohmic contact with the thermistor body 21. A gap is created between the outer end of the second electrode 24 and the inner end of the first electrode 22 because the second electrodes are not in physical contact with the first electrodes. Similarly, a gap is formed between the outer end of the second electrode 25 and the inner end of the first electrode 23.

In the thermistor device constructed as described above, if a potential difference is developed between the second electrodes 24 and 25, atoms of Ag forming the second electrodes 24 and 25 do not migrate for the following reason. Referring to FIG. 6, current paths are represented by arrows 26, A and D represent the outer ends of the second electrodes 24 and 25, respectively, and E and F represent the inner ends of the first electrodes 22 and 23, respectively, and B and C represent the left and right edges, respectively, of the outer end surfaces of the thermistor body 21. A potential difference attributed to the resistive component of the thermistor body 21 is produced between the ends A and E, between the edges B and C, and between the ends F and D on the surface of the thermistor body 21. However, no potential difference is created between B and E or between C and F because of the presence of the first electrodes 22 and 23. Even if the atoms of Ag in the second electrodes 24 and 25 move between A and E or between F and D, the first electrodes 22 and 23 prevent further migration of these Ag atoms. Hence, a thermistor device having highly reliable insulation is obtained.

It is to be understood that the invention is not limited to the illustrated examples and that various changes and modifications are possible within the scope of the invention delineated by the accompanying claims.

As can be understood from the description given thus far, according to the invention, first and second electrodes are formed on the front and back surfaces, respectively, of a thermistor body. The conventional cumbersome operation of coating the outer surface of the thermistor body with an insulating film can be omitted. As a result, the manufacturing cost can be reduced.

Furthermore, the first electrodes made from a conductive material not containing Ag are formed in peripheral portions of the front and back surfaces, respectively, of the thermistor body. The second electrodes made from a conductive material consisting mainly of Ag are formed at least in central portions of the front and back surfaces, respectively, of the thermistor body. Therefore, even if a potential difference is produced between the second electrodes, the first electrodes prevent the atoms of Ag in the second electrodes from migrating. Consequently, a thermistor device exhibiting highly reliable insulation is derived.

What is claimed is:

1. A thermistor device comprising:

a thermistor body having a front surface and a back surface;

first electrodes made from a conductive material not containing silver and located in physical contact with peripheral portions of the front and back surfaces, respectively, of said thermistor body; and second electrodes made from a conductive material including silver and located in physical contact with at least central portions of the front and back surfaces, respectively, of said thermistor body, wherein said second electrodes are not in physical contact with said first electrodes whereby a gap exists between said first and second electrodes;

wherein said first electrodes prevent migration of silver from extending beyond said gap between said first and second electrodes.

2. The thermistor device of claim 1, wherein said first electrodes are made from a material containing at least one of the materials selected from a group consisting of nickel, aluminum, indium, gallium, chromium, zinc, copper, and alloys thereof.

3. The thermistor device of claim 1, wherein said second electrodes are in ohmic contact with said thermistor body.

4. The thermistor device of claim 1, wherein portions of said front and back surfaces of said thermistor body are not covered by said first electrodes and said second electrodes, respectively.

5. A thermistor device comprising:

a thermistor body having a front surface and a back surface;

first electrodes made from a conductive material not containing silver and located in physical contact with first portions of the front and back surfaces, respectively, of said thermistor body; and second electrodes made from a conductive material including silver and located in physical contact with at least second portions, which are different than said first portions, of the front and back surfaces, respectively, of said thermistor body, wherein said second electrodes are not in physical contact with said first electrodes and a gap is formed between said first and said second electrodes;

wherein said first electrodes prevent migration of silver from extending beyond said gap between said first and second electrodes.

6. The thermistor device of claim 5, wherein said first electrodes are made from a material containing at least one of the materials selected from a group consisting of nickel, aluminum, indium, gallium, chromium, zinc, copper, and alloys thereof.

7. The thermistor device of claim 5, wherein said second electrodes are in ohmic contact with said thermistor body.

8. The thermistor device of claim 5, wherein portions of said front and back surfaces of said thermistor body are not covered by said first electrodes and said second electrodes, respectively.

9. The thermistor device of claim 5, wherein said second selected portions are surrounded by said first selected portions on said front and back surfaces of said thermistor body.

10. A thermistor device, comprising:

a thermistor body having a front surface and a back surface;

first electrodes made from a conductive material consisting essentially of material which does not generate inter-electrode migration and located in physical contact with peripheral portions of the front and back surfaces, respectively, of said thermistor body; and second electrodes made from a conductive material consisting essentially of a material which generates inter-electrode migration and located in physical contact with at least central portions of the front and back surfaces, respectively, of said thermistor body, wherein said second electrodes are not in physical contact with said first electrodes whereby a gap exists between said first and second electrodes.

11. A thermistor device, comprising:

a thermistor body having a front surface and a back surface;

first electrodes node from a conductive material consisting essentially of material which does not generate inter-electrode migration and located in physical contact with peripheral portions of the front and back surfaces, respectively, of said thermistor body; and second electrodes made from a conductive material consisting essentially of a material which generates inter-electrode migration and located in physical contact with at least central portions of the front and back surfaces, respectively, of said thermistor body, wherein said second electrodes are consistently thicker and of a greater surface area than said first electrodes to provide a consistently planar surface over all of an outermost surface of said second electrodes on the front and back surfaces of the thermistor body, and wherein said second electrodes are not in physical contact with said first electrodes whereby a gap exists between said first and second electrodes.

12. The thermistor device of claim 11, wherein said first electrodes are made from a material containing at least one of the materials selected from a group consisting of nickel, aluminum, indium, gallium, chromium, zinc, copper, and alloys thereof.

13. The thermistor device of claim 11, wherein said second electrodes are in electrical contact with said first electrodes.

* * * * *